US010926502B2

(12) United States Patent
Zhang et al.

(10) Patent No.: US 10,926,502 B2
(45) Date of Patent: Feb. 23, 2021

(54) EFFICIENT ENERGY-SAVING RETURN CYLINDER OF HYDRAULIC PRESS AND WORKING METHOD THEREOF

(71) Applicant: ZHONGKEJUXIN CLEAN ENERGY & HOT FORGING EQUIPMENT RESEARCH AND DEVELOPMENT CO., LTD., Jiangsu (CN)

(72) Inventors: Lianhua Zhang, Jiangsu (CN); Hui Zhang, Jiangsu (CN)

(73) Assignee: Zhongkejuxin Clean Energy & Hot Forging Equipment Research and Development Co., Ltd., Jiangsu (CN)

( * ) Notice: Subject to any disclaimer, the term of this patent is extended or adjusted under 35 U.S.C. 154(b) by 0 days.

(21) Appl. No.: 16/307,112

(22) PCT Filed: Jun. 14, 2018

(86) PCT No.: PCT/CN2018/091240
§ 371 (c)(1),
(2) Date: Dec. 4, 2018

(87) PCT Pub. No.: WO2019/085491
PCT Pub. Date: May 9, 2019

(65) Prior Publication Data

US 2020/0262169 A1 Aug. 20, 2020

(30) Foreign Application Priority Data

Nov. 2, 2017 (CN) ..... 2017 1 1061950

(51) Int. Cl.
*F15B 1/04* (2006.01)
*B30B 15/16* (2006.01)
(Continued)

(52) U.S. Cl.
CPC ..... *B30B 15/163* (2013.01); *F15B 1/04* (2013.01); *F15B 15/1428* (2013.01);
(Continued)

(58) Field of Classification Search
CPC .... F15B 2211/625; F15B 1/04; B30B 15/163; B30B 15/16
See application file for complete search history.

(56) References Cited

FOREIGN PATENT DOCUMENTS

CN 102974732 3/2013
CN 204674066 9/2015
(Continued)

*Primary Examiner* — Abiy Teka
(74) *Attorney, Agent, or Firm* — IP & T Group LLP

(57) ABSTRACT

Provided are an efficient energy-saving return cylinder of a hydraulic press and a working method thereof. The efficient energy-saving return cylinder of a hydraulic press comprises a plurality of single-rod return hydraulic cylinders symmetrically distributed at two sides of a main hydraulic cylinder of the hydraulic press, the plurality of single-rod return hydraulic cylinders are divided into several groups, each of the groups consisting of one balancing cylinder and one driving cylinder; a rod chamber of the balancing cylinder is communicated with an accumulator, the pressurized oil in the accumulator is filled into an oil chamber of the balancing cylinder, so that the balancing cylinder balances the weight of a walking beam and a working part of the walking beam; the driving cylinder is differentially connected; in the process of neutral-stroke-rapid-descending and ascending-returning of the walking beam and the working part of the walking beam.

20 Claims, 3 Drawing Sheets

(51) Int. Cl.
*F15B 15/14* (2006.01)
*F15B 15/20* (2006.01)

(52) U.S. Cl.
CPC ..... *F15B 15/20* (2013.01); *F15B 2211/20576* (2013.01); *F15B 2211/212* (2013.01); *F15B 2211/625* (2013.01)

(56) References Cited

FOREIGN PATENT DOCUMENTS

| | | | | |
|---|---|---|---|---|
| CN | 206175358 | | 5/2017 | |
| CN | 107672222 | | 2/2018 | |
| JP | 2000218400 | | 8/2000 | |
| WO | WO-2013167610 | A1 * | 11/2013 | ..... F15B 11/064 |

* cited by examiner

EFFICIENT ENERGY-SAVING RETURN CYLINDER OF HYDRAULIC PRESS AND WORKING METHOD THEREOF

CROSS-REFERENCE TO RELATED APPLICATIONS

This application is a national stage application of PCT/CN2018/091240 filed on Jun. 14, 2018, which claims the priority of the Chinese patent application No. 201711061950.5 on Nov. 2, 2017 and entitled "Efficient Energy-saving Return Cylinder of Hydraulic Press" The disclosure of each of the foregoing applications is incorporated herein by reference in its entirety.

TECHNICAL FIELD

The present disclosure relates to a return cylinder of a hydraulic press and a working method thereof, and particularly to an efficient energy-saving return cylinder which realizes driving of a large-mass hydraulic press by a small power by means of a balance assisting configuration, belonging to the technical field of hydraulic transmission.

BACKGROUND ART

One working cycle of a hydraulic press includes walking beam descending working and ascending-returning. The cyclic operation of a traditional hydraulic press is implemented in a way that a main hydraulic pump and a liquid filled tank supply pressurized oil to a main hydraulic cylinder to cause a walking beam of the hydraulic press and a working part of the walking beam to descend rapidly for work; and in a retuning process, that the main hydraulic pump switches to supply pressurized oil to a return cylinder, the oil in the main hydraulic cylinder returns to an oil tank, and the walking beam and the working part of the walking beam ascend to realize returning. Since the walking beam of the hydraulic press has a relatively great weight, multiple hydraulic pumps are required at the time of returning to simultaneously supply a large amount of pressurized oil into the return cylinder, in order to meet the requirement of large return linear speed. This kind of return working condition not only consumes much energy and has a low working efficiency, but also has the disadvantages that the hydraulic press is slow in response, has large vibrations and much noise, which does not meet the energy-saving and consumption-reducing requirement of the modern industry. Therefore, the return working condition of the traditional hydraulic press still needs to be further improved.

SUMMARY

In view of the technical deficiencies in the return working condition of a traditional hydraulic press, the present disclosure proposes an efficient energy-saving return cylinder of a hydraulic press and a working method thereof, which adopts a balance configuration and greatly reduces the impact of the weight of the walking beam of the press on the working process of the press, thereby reducing the obstruction to the flexibility of movement of the walking beam imposed by the weight of the walking beam, so as to achieve the objectives of small energy consumption, fast response and high working efficiency of the return working condition.

In order to achieve the above objects, the present disclosure is implemented using the following technical solution: an efficient energy-saving return cylinder of a hydraulic press, including a plurality of single-rod return hydraulic cylinders symmetrically distributed at two sides of a main hydraulic cylinder of the hydraulic press, cylinder bodies of the single-rod return hydraulic cylinders being fixed on a fixing beam of the hydraulic press, a single rod of each single-rod return hydraulic cylinder being connected with a walking beam of the hydraulic press and cooperating with a hydraulic pump, an accumulator and the main hydraulic cylinder of the hydraulic press to complete neutral-stroke-rapid-descending, working-upon-pressing and ascending-returning of the walking beam of the hydraulic press and a working part the walking beam; and a pressure in the accumulator being set to be constant. Specifically, the plurality of single-rod return hydraulic cylinders are divided into several groups, each of the groups consisting of one balancing cylinder and one driving cylinder. The accumulator is communicated with a rod chamber of the balancing cylinder. During a process of normal operation, pressurized oil in the accumulator is filled into the rod chamber of the balancing cylinder, so that a piston of the balancing cylinder has an upward buoyant force, with the buoyant force balancing weight of the walking beam and the working part of the walking beam. And in a descending working process of the walking beam, a rodless chamber of the driving cylinder is filled with pressurized oil, the pressurized oil in a rod chamber of the driving cylinder returns to an oil tank, and the pressurized oil in an oil chamber of the balancing cylinder is pressed into the accumulator, and the walking beam and the working part of the walking beam undergo the neutral-stroke-rapid-descending. In an ascending-returning process of the walking beam, the rod chamber of the driving cylinder is filled with pressurized oil, the return oil in the rodless chamber of the driving cylinder flows into the oil tank, and the upward buoyant force of the piston of the balancing cylinder and a driving force generated by the driving cylinder jointly drive the walking beam and the working part of the walking beam to implement the ascending-returning.

Further, the balancing cylinder and the driving cylinder are provided integratedly, and the driving cylinder is provided in a piston rod of the balancing cylinder, that is, the piston rod of the balancing cylinder is a cylinder body of the driving cylinder. The piston rod of the balancing cylinder is connected with the walking beam, that is, the cylinder body of the driving cylinder is connected with the walking beam. A piston rod of the driving cylinder passes through a rodless chamber of the balancing cylinder such that an end of the piston rod of the driving cylinder extends to the outside of a cylinder body of the balancing cylinder, and is fixedly connected with the cylinder body of balancing cylinder in a sealing manner. Two oil pipes are provided in the piston rod of the driving cylinder, with one oil pipe extending from the end of the piston rod of the driving cylinder into the rodless chamber of the driving cylinder, and the other oil pipe extending from the end of the piston rod of the driving cylinder into the rod chamber of the driving cylinder.

Further, the balancing cylinder and the driving cylinder are provided separately, and the piston rod of the balancing cylinder and the piston rod of the driving cylinder each are connected with the walking beam.

Further, in the case where the balancing cylinder and the driving cylinder are provided integratedly, the two oil pipes provided in the piston rod of the driving cylinder are communicated with each other, so that the rodless chamber and the rod chamber of the driving cylinder are communicated with each other, and the rodless chamber and the rod chamber of the driving cylinder are further communicated with an outlet of the hydraulic pump which outputs the pressurized oil, thereby constituting differential connection of the driving cylinder, so as to implement the neutral-stroke-rapid-descending of the walking beam and the working part of the walking beam.

Further, in the case where the balancing cylinder and the driving cylinder are provided separately, the driving cylinder is in differential connection, implementing neutral-stroke-rapid-descending of the walking beam and the working part of the walking beam.

Further, the constant pressure in the accumulator causes the upward buoyant force of the piston of the balancing cylinder to be less than or equal to the weight of the walking beam and the working part of the walking beam.

Further, an area of a piston of the rodless chamber of the driving cylinder is twice an area of the piston rod of the driving cylinder, so that the walking beam of the hydraulic press and the working part of the walking beam undergo the neutral-stroke-rapid-descending and the ascending-returning at a same speed.

Further, in a process of the ascending-returning of the walking beam and the working part of the walking beam, the driving force generated by the driving cylinder is smaller than the weight of the walking beam and the working part of the walking beam. Further, a three-position four-way electromagnetic directional valve is provided on the pipes at a place where the rodless chamber and the rod chamber of the driving cylinder are communicated with the outlet of the hydraulic pump which outputs pressurized oil.

Further, a two-position three-way electromagnetic directional valve is provided on the pipes at a place where the rodless chamber and the rod chamber of the driving cylinder are communicated with each other.

Further, when the two-position three-way electromagnetic directional valve is not energized, the driving cylinder is in a normally connection, and when the two-position three-way electromagnetic directional valve is energized, the driving cylinder is differentially connected.

Further, when the two-position three-way electromagnetic directional valve is not energized, the driving cylinder is in a normal connection.

Further, when the two-position three-way electromagnetic directional valve is energized, the driving cylinder is differentially connected.

The present disclosure provides a working method of an efficient energy-saving return cylinder of a hydraulic press, including the following steps:

balancing an upward buoyant force of a piston of a balancing cylinder and weight of a walking beam and a working part of the walking beam, in a balancing state;

jointly driving, by a driving force of a driving cylinder and the weight of the walking beam and the working part of the walking beam, the walking beam and the working part of the walking beam to descend, in a descending state; and jointly driving, by the buoyant force of the piston of the balancing cylinder and the driving force generated by the driving cylinder, the walking beam and the working part of the walking beam to implement ascending-returning, in an ascending state.

Further, in the balancing state, the working method further includes the following steps: filling pressurized oil in an accumulator into a rod chamber of the balancing cylinder, and balancing, using the upward buoyant force of the piston of the balancing cylinder, the weight of the walking beam and the working part of the walking beam.

Further, in the descending state, the working method further includes following steps: filling a rodless chamber of the driving cylinder with pressurized oil, making the pressurized oil in a rod chamber of the driving cylinder return to an oil tank, pressing the pressurized oil in the rod chamber of the balancing cylinder into the accumulator, sucking air into a rodless chamber of the balancing cylinder through a breathing port, thereby making the walking beam and the working part of the walking beam undergo neutral-stroke-rapid-descending.

Further, in the ascension state, the working method further includes following steps: filling the rod chamber of the driving cylinder with the pressurized oil, making oil in the rodless chamber of the driving cylinder flow back to the oil tank, filling by the accumulator the pressurized oil into the rod chamber of the balancing cylinder, and discharging air in the rodless chamber of the balancing cylinder through the breathing port, so that the piston of the balancing cylinder has an upward buoyant force, and the upward buoyant force and the driving force generated by the driving cylinder jointly drive the walking beam and the working part of the walking beam to implement the ascending-returning.

By means of the technical solutions described above, the present disclosure can achieve the following advantageous effects:

1. the rod chamber of the balancing cylinder is communicated with the accumulator, and the piston rod of the balancing cylinder is fixedly connected with the walking beam, which thereby serves the function of balancing the weight of the walking beam and the working part of the walking beam, so that the weight of the walking beam and the working part of the walking beam is always close to zero. In such a balancing state, descending working and ascending-returning of the walking beam and the working part of the walking beam can always be achieved as long as a very small motive force is applied to the walking beam, which effectively reduces the number of hydraulic pumps deployed, thereby saving energy and production cost;

2. the driving cylinder is provided in the piston rod of the balancing cylinder, and forms a differential connection structure, which not only reduces the structural configuration space, but also can effectively realize the neutral-stroke-rapid-descending and ascending-returning of the walking beam and the working part of the walking beam under the condition that the balancing cylinder balances the weight of the walking beam and the working part thereof; and 3. a relatively small amount of oil is injected into the driving cylinder, which reduces the working vibration and noise of the hydraulic press.

BRIEF DESCRIPTION OF DRAWINGS

In order to more clearly illustrate the technical solutions of the embodiments of the present disclosure or in the prior art, brief description is made below on the drawings required to be used in the description of the embodiments or the prior art. Obviously, the following drawings illustrate some of the embodiments of the present disclosure, and for a person of ordinary skills in the art, other drawings may be obtained from these drawings without inventive effort.

In FIGS. 1, 2 and 3, 1 denotes hydraulic pump, 2 denotes a three-position four-way electromagnetic directional valve, 3 denotes a two-position three-way electromagnetic directional valve, 4 denotes a main hydraulic cylinder, 5 denotes a single-rod return hydraulic cylinder, 501 denotes a cylinder body of a balancing cylinder, 502 denotes a piston of the balancing cylinder, 503 denotes a piston rod of the balancing cylinder, which also serves as the cylinder body of a driving cylinder, 504 denotes a rodless chamber of the balancing cylinder, 505 denotes a rod chamber of the balancing cylinder, 506 denotes a piston of the driving cylinder, 507 denotes a piston rod of the driving cylinder, 508 denotes a rodless chamber of the driving cylinder, 509 denotes a rod chamber of the driving cylinder, 510 and 511 denote oil pipes, 6 denotes a walking beam, 7 denotes an accumulator, and b denotes a breathing port.

DETAILED DESCRIPTION OF EMBODIMENTS

The technical solutions of the present disclosure will be clearly and completely described below with reference to the drawings. Obviously, the embodiments described are some of the embodiments of the present disclosure, rather than all of the embodiments of the present disclosure. All the other embodiments that are obtained by a person of ordinary skills in the art on the basis of the embodiments of the present disclosure without inventive effort shall be covered by the protection scope of the present disclosure.

In the description of the present disclosure, it should be noted that the orientation or position relationships denoted by the terms such as "center", "upper", "lower", "left", "right", "vertical", "horizontal", "inner" and "outer" is based on the orientation or position relationships indicated by the figures, which only serves to facilitate describing the present disclosure and simplify the description, rather than indicating or suggesting that the device or element referred to must have a particular orientation, or is constructed and operated in a particular orientation, and therefore cannot be construed as a limitation of the present disclosure. In addition, the terms "first", "second" and "third" (if present) merely serve the purpose of description, but cannot be construed as an indication or suggestion of relative importance.

In the description of the present disclosure, it should be noted that unless otherwise explicitly specified or defined, the terms "install", "link" and "connect" (if present) shall be understood in broad sense, which may, for example, refer to fixed connection, detachable connection or integral connection; may refer to mechanical connection or electrical connection; may refer to direct connection or indirect connection by means of an intermediate medium; and may refer to communication between two elements. A person of ordinary skills in the art could understand the specific meaning of the terms in the present disclosure according to specific situations.

Figure 1:
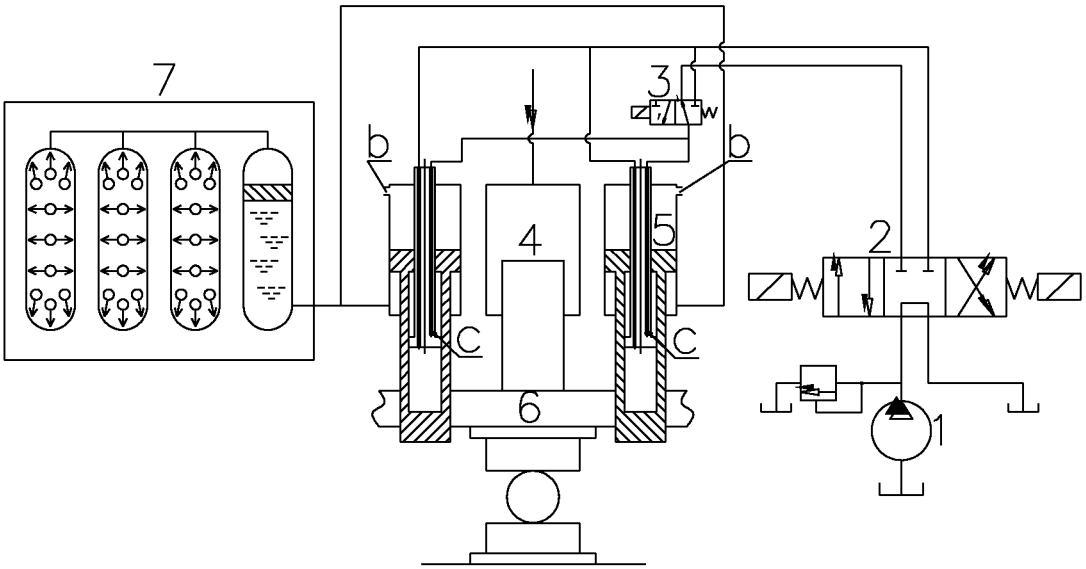
FIG. 1 is a schematic structural diagram of embodiment I of the present disclosure.
Figure 2:
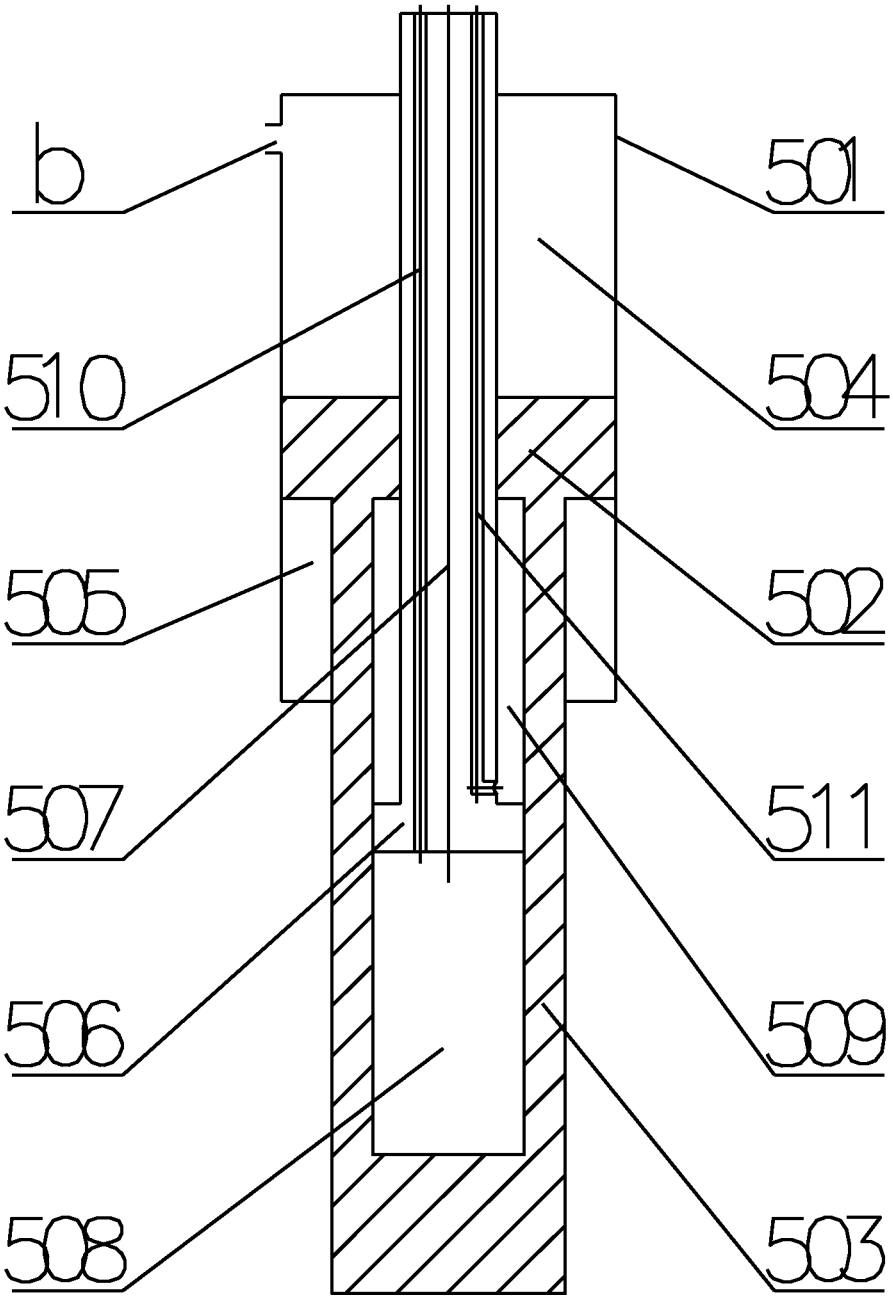
FIG. 2 is a schematic structural diagram of a return hydraulic cylinder in embodiment I of the present disclosure.
Figure 3:
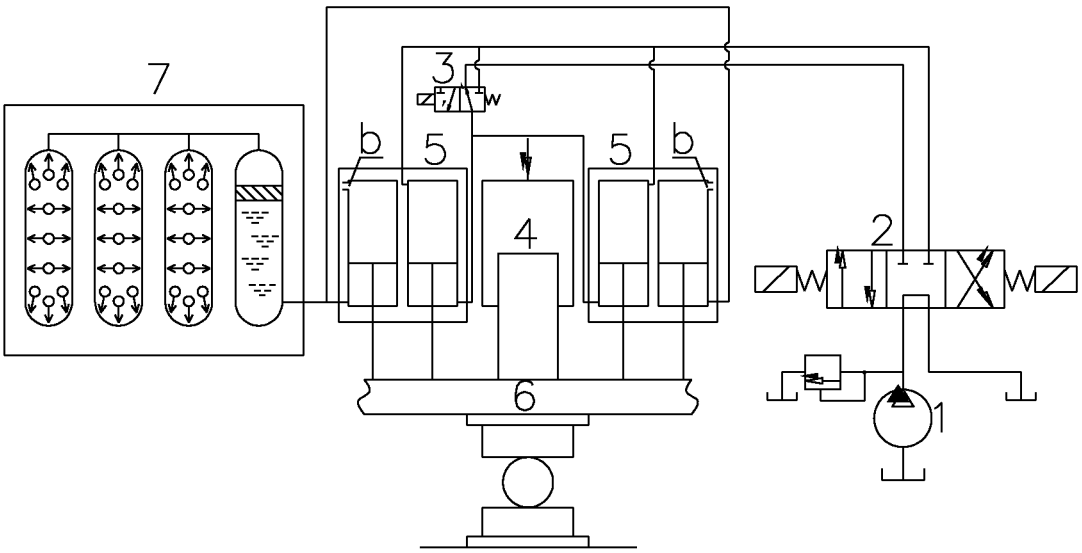
FIG. 3 is a schematic structural diagram of embodiment II of the present disclosure.

As shown in FIGS. 1, 2 and 3, the present disclosure includes a plurality of single-rod return hydraulic cylinders 5 symmetrically distributed at two sides of a main hydraulic cylinder 4 of the hydraulic press, cylinder bodies of the single-rod return hydraulic cylinders 5 are fixed on a fixing beam of the hydraulic press, the single rod is connected with a walking beam 6 of the hydraulic press and cooperates with a hydraulic pump 1, an accumulator 7 and the main hydraulic cylinder 4 of the hydraulic press to complete neutral-stroke-rapid-descending, working-upon-pressing and ascending-returning of the walking beam 6 of the hydraulic press and a working part of the walking beam; a pressure in the accumulator 7 is set to be constant; the plurality of single-rod return hydraulic cylinders 5 are divided into several groups, each of the groups consisting of one balancing cylinder and one driving cylinder; the accumulator 7 is communicated with a rod chamber 505 of the balancing cylinder, and during the process of normal operation, pressurized oil in the accumulator 7 is filled into the rod chamber 505 of the balancing cylinder, so that a piston 502 of the balancing cylinder has an upward buoyant force, with the buoyant force balancing the weight of the walking beam 6 and the working part of the walking beam; in the descending working process of the walking beam 6, a rodless chamber 508 of the driving cylinder is filled with pressurized oil, the pressurized oil in a rod chamber 509 of the driving cylinder returns to an oil tank, the pressurized oil in the rod chamber 505 of the balancing cylinder is pressed into the accumulator 7, air is sucked into a rodless chamber 504 of the balancing cylinder through a breathing port b, and the walking beam 6 and the working part of the walking beam undergo neutral-stroke-rapid-descending; in the process of the ascending-returning of the walking beam 6, the rod chamber 509 of the driving cylinder is filled with the pressurized oil, the oil in the rodless chamber 508 of the driving cylinder flows back to the oil tank, the accumulator 7 fills the pressurized oil into the rod chamber of the balancing cylinder, the air in the rodless chamber 504 of the balancing cylinder is discharged through the breathing port b, the piston 502 of the balancing cylinder has an upward buoyant force, and the buoyant force and the driving force generated by the driving cylinder jointly drive the walking beam 6 and the working part of the walking beam to realize ascending-returning; and the constant pressure in the accumulator 7 causes the upward buoyant force of the piston 502 of the balancing cylinder to be less than or equal to the weight of the walking beam 6 and the working part of the walking beam. The area of the piston in the rodless chamber 508 of the driving cylinder is twice the ring-shaped area of the piston rod in the rod chamber 509 of the driving cylinder, so that the walking beam 6 of the hydraulic press and the working part of the walking beam undergo neutral-stroke-rapid-descending and ascending-returning at the same speed; in the ascending-returning process of the walking beam 6 and the working part of the walking beam, the driving force of the driving cylinder is smaller than the weight of the walking beam 6 and the working part of the walking beam; a three-position four-way electromagnetic directional valve 2 is provided on a pipe at a place where the rodless chamber 508 of the driving cylinder and the rod chamber 509 of the driving cylinder are communicated with the outlet of the hydraulic pump which outputs the pressurized oil; a two-position three-way electromagnetic directional valve 3 is provided on a pipe at a place where the rodless chamber 508 of the driving cylinder and the rod chamber 509 of the driving cylinder are communicated with each other, when the two-position three-way electromagnetic directional valve is not energized, the driving cylinder is in a normal connection, and when the two-position three-way electromagnetic directional valve is energized, the driving cylinder is in differential connection.

In the above, the breathing port b can control air balance inside the rodless chamber 504 of the balancing cylinder, which therefore allows for suction or discharge of air, ensuring that the piston 502 of the balancing cylinder has a buoyant force or a downward driving force.

Embodiment I

As shown in FIG. 3, the balancing cylinder and the driving cylinder are provided integratedly, and the driving cylinder is provided in the piston rod 503 of the balancing cylinder, that is, the piston rod 503 of the balancing cylinder is the cylinder body 503 of the driving cylinder, and the piston rod 503 of the balancing cylinder is connected with the walking beam 6, that is, the cylinder body 503 of the driving cylinder is connected with the walking beam 6; the piston rod 507 of the driving cylinder passes through the rodless chamber 504 of the balancing cylinder such that an end of the piston rod 507 of the driving cylinder extends to the outside of the cylinder body 501 of the balancing cylinder, and is fixedly connected with the cylinder body 501 of the balancing cylinder in a sealing manner; and two oil pipes 510 and 511 are provided in the piston rod 507 of the driving cylinder, with the oil pipe 510 extending from one end of the piston rod 507 of the driving cylinder into the rodless chamber 508 of the driving cylinder, and the oil pipe 511 extending from one end of the piston rod 507 of the driving cylinder into the rod chamber 509 of the driving cylinder; the two oil pipes 510 and 511 are communicated with each other, that is, the rodless chamber 508 of the driving cylinder and the rod chamber 509 of the driving cylinder are communicated with each other, and the rodless chamber 508 of the driving cylinder and the rod chamber 509 of the driving cylinder further communicate with the outlet of the hydraulic pump which outputs the pressurized oil, thereby constituting differential connection of the driving cylinder, and realizing neutral-stroke-rapid-descending of the walking beam 6 and the working part of the walking beam.

In the above, a plurality of oil inlets may be provided between the oil pipe 510 and the rodless chamber 508 of the driving cylinder, which can further improve the oil intake efficiency of the rodless chamber 508 of the driving cylinder.

A plurality of oil inlets may also be provided between the oil pipe 511 and the rod chamber 509 of the driving cylinder to improve the oil intake efficiency of the rod chamber 509 of the driving cylinder.

Embodiment II

As shown in FIG. 3, the balancing cylinder and the driving cylinder are provided separately, and the piston rod of the balancing cylinder and the piston rod of the driving cylinder are connected with the walking beam 6; the driving cylinder is in differential connection, realizing neutral-stroke-rapid-descending of the walking beam 6 and the working part of the walking beam.

In the present disclosure, the return cylinder consists of a plurality of single-rod return hydraulic cylinders 5 symmetrically distributed at two sides of the main hydraulic cylinder 4 of the hydraulic press, the plurality of single-rod return hydraulic cylinders 5 are divided into several groups, each of the groups including one balancing cylinder and one driving cylinder, in which the rod chamber 505 of the balancing cylinder is communicated with the accumulator 7, such that the piston 502 of the balancing cylinder has an upward buoyant force, with the buoyant force balancing the weight of the walking beam 6, and in such a balancing state, neutral-stroke-rapid-descending and ascending-returning of the walking beam 6 and the working part of the walking beam can always be achieved as long as a very small motive force is applied to the walking beam 6, which therefore can effectively reduce the number of hydraulic pumps deployed, thereby saving energy and production cost; moreover, the driving cylinder is a differential hydraulic cylinder, which thereby increases the speed of neutral-stroke-rapid-descending and ascending-returning of the walking beam 6; and in the present disclosure, since a relatively small amount of pressurized oil is injected into the driving cylinder, the working vibration and noise of the hydraulic press can be reduced to a great extent.

Embodiment III

The working method of an efficient energy-saving return cylinder of a hydraulic press provided in this embodiment includes the following steps: balancing a buoyant force of a piston of a balancing cylinder and the weight of a walking beam and a working part of the walking beam, in a balancing state; jointly driving, by a driving force of a driving cylinder and the weight of the walking beam and the working part of the walking beam, the walking beam and the working part of the walking beam to descend, in a descending state; and jointly driving, by the buoyant force of the piston of the balancing cylinder and the driving force generated by the driving cylinder, the walking beam and the working part of the walking beam to realize ascending in an ascending state.

Specifically, in the balancing state, the working method further includes the following steps: filling the pressurized oil in an accumulator into a rod chamber of the balancing cylinder, and balancing, using the upward buoyant force of the piston of the balancing cylinder, the weight of the walking beam and the working part of the walking beam.

In the descending state, the working method further includes the following steps: filling a rodless chamber of the driving cylinder with pressurized oil, making the pressurized oil in a rod chamber of the driving cylinder return to an oil tank, pressing the pressurized oil in the rod chamber of the balancing cylinder into the accumulator, sucking air into a rodless chamber of the balancing cylinder through a breathing port, thereby making the walking beam and the working part of the walking beam undergo neutral-stroke-rapid-descending.

In the ascending state, the working method further includes the following steps: filing the rod chamber of the driving cylinder with the pressurized oil, making the oil in the rodless chamber of the driving cylinder flow back to the oil tank, filling by the accumulator the pressurized oil into the rod chamber of the balancing cylinder, and discharging the air in the rodless chamber of the balancing cylinder through the breathing port, so that the piston of the balancing cylinder has an upward buoyant force, and the buoyant force and the driving force generated by the driving cylinder jointly drive the walking beam and the working part of the walking beam to realize ascending-returning.

The description above is merely preferred embodiments of the present disclosure, which are not used to restrict the present disclosure. For those skilled in the art, the present disclosure may have various changes and variations. Any modifications, equivalent substitutions, or improvements, etc. made within the spirit and principle of the present disclosure shall all be included in the scope of protection of the present disclosure.

INDUSTRIAL APPLICABILITY

The efficient energy-saving return cylinder of a hydraulic press provided in the embodiments of the present disclosure realizes the rapid descending and ascending of the walking beam and the working part of the walking beam, reduces the number of hydraulic pumps deployed, and reduces the working vibration and noise of the hydraulic press, thereby saving energy and production cost.

The invention claimed is:

1. An efficient energy-saving return cylinder of a hydraulic press, comprising a plurality of single-rod return hydraulic cylinders symmetrically distributed at two sides of a main hydraulic cylinder of the hydraulic press, cylinder bodies of the single-rod return hydraulic cylinders being fixed on a fixing beam of the hydraulic press, a single rod of each single-rod return hydraulic cylinder being connected with a walking beam of the hydraulic press and cooperating with a hydraulic pump, an accumulator and the main hydraulic cylinder of the hydraulic press to complete neutral-stroke-rapid-descending, working-upon-pressing and ascending-returning of the walking beam of the hydraulic press and a working part of the walking beam; and a pressure in the accumulator being set to be constant, wherein the plurality of single-rod return hydraulic cylinders are divided into several groups, each of the groups consisting of one balancing cylinder and one driving cylinder; the accumulator is communicated with a rod chamber of the balancing cylinder, wherein during a process of normal operation, pressurized oil in the accumulator is filled into the rod chamber of the balancing cylinder, so that a piston of the balancing cylinder has an upward buoyant force, with the buoyant force balancing weight of the walking beam and the working part of the walking beam; and in a descending working process of the walking beam, a rodless chamber of the driving cylinder is filled with pressurized oil, the pressurized oil in a rod chamber of the driving cylinder returns to an oil tank, and the pressurized oil in an oil chamber of the balancing cylinder is pressed into the accumulator, and the walking beam and the working part of the walking beam undergo the neutral-stroke-rapid-descending; in an ascending-returning process of the walking beam, the rod chamber of the driving cylinder is filled with pressurized oil, oil in the rodless chamber of the driving cylinder flows into the oil tank, and the upward buoyant force of the piston of the balancing cylinder and a driving force generated by the driving cylinder jointly drive the walking beam and the working part of the walking beam to implement the ascending-returning.

2. The efficient energy-saving return cylinder of a hydraulic press according to claim 1, wherein the balancing cylinder and the driving cylinder are provided integratedly, and the driving cylinder is provided in a piston rod of the balancing cylinder, that is, the piston rod of the balancing cylinder is a cylinder body of the driving cylinder, the piston rod of the balancing cylinder is connected with the walking beam, that is, the cylinder body of the driving cylinder is connected with the walking beam; a piston rod of the driving cylinder passes through a rodless chamber of the balancing cylinder such that an end of the piston rod of the driving cylinder extends to outside of a cylinder body of the balancing cylinder, and is fixedly connected with the cylinder body of balancing cylinder in a sealing manner; and two oil pipes are provided in the piston rod of the driving cylinder, with one oil pipe extending from the end of the piston rod of the driving cylinder into the rodless chamber of the driving cylinder, and the other oil pipe extending from the end of the piston rod of the driving cylinder into the rod chamber of the driving cylinder.

3. The efficient energy-saving return cylinder of a hydraulic press according to claim 2, wherein in the case where the balancing cylinder and the driving cylinder are provided integratedly, the two oil pipes provided in the piston rod of the driving cylinder are communicated with each other, so that the rodless chamber and the rod chamber of the driving cylinder are communicated with each other, and the rodless chamber and the rod chamber of the driving cylinder are further communicated with an outlet of the hydraulic pump which outputs the pressurized oil, thereby constituting differential connection of the driving cylinder, so as to implement the neutral-stroke-rapid-descending of the walking beam and the working part of the walking beam.

4. The efficient energy-saving return cylinder of a hydraulic press according to claim 3, wherein a two-position three-way electromagnetic directional valve is provided on the pipes at a place where the rodless chamber and the rod chamber of the driving cylinder are communicated with each other.

5. The efficient energy-saving return cylinder of a hydraulic press according to claim 4, wherein when the two-position three-way electromagnetic directional valve is not energized, the driving cylinder is in a normal connection.

6. The efficient energy-saving return cylinder of a hydraulic press according to claim 4, wherein when the two-position three-way electromagnetic directional valve is energized, the driving cylinder is in differential connection.

7. The efficient energy-saving return cylinder of a hydraulic press according to claim 2, wherein an area of a piston of the rodless chamber of the driving cylinder is twice an area of the piston rod of the driving cylinder, so that the walking beam of the hydraulic press and the working part of the walking beam undergo the neutral-stroke-rapid-descending and the ascending-returning at a same speed.

8. The efficient energy-saving return cylinder of a hydraulic press according to claim 1, wherein the balancing cylinder and the driving cylinder are provided separately, and the piston rod of the balancing cylinder and the piston rod of the driving cylinder each are connected with the walking beam.

9. The efficient energy-saving return cylinder of a hydraulic press according to claim 8, wherein in the case where the balancing cylinder and the driving cylinder are provided separately, the driving cylinder is in differential connection, implementing neutral-stroke-rapid-descending of the walking beam and the working part of the walking beam.

10. The efficient energy-saving return cylinder of a hydraulic press according to claim 1, wherein the constant pressure in the accumulator causes the upward buoyant force of the piston of the balancing cylinder to be less than or equal to the weight of the walking beam and the working part of the walking beam.

11. The efficient energy-saving return cylinder of a hydraulic press according to claim 1, wherein an area of a piston of the rodless chamber of the driving cylinder is twice an area of the piston rod of the driving cylinder, so that the walking beam of the hydraulic press and the working part of the walking beam undergo the neutral-stroke-rapid-descending and the ascending-returning at a same speed.

12. The efficient energy-saving return cylinder of a hydraulic press according to claim 1, wherein in a process of the ascending-returning of the walking beam and the working part of the walking beam, the driving force generated by the driving cylinder is smaller than the weight of the walking beam and the working part of the walking beam.

13. The efficient energy-saving return cylinder of a hydraulic press according to claim 1, wherein a three-position four-way electromagnetic directional valve is provided on the pipes at a place where the rodless chamber and the rod chamber of the driving cylinder are communicated with the outlet of the hydraulic pump which outputs pressurized oil.

14. A working method of the efficient energy-saving return cylinder of a hydraulic press according to claim 1, comprising following steps:

balancing a buoyant force of a piston of a balancing cylinder and weight of a walking beam and a working part of the walking beam, in a balancing state;

jointly driving, by a driving force of a driving cylinder and the weight of the walking beam and the working part of the walking beam, the walking beam and the working part of the walking beam to descend, in a descending state; and jointly driving, by the buoyant force of the piston of the balancing cylinder and the driving force generated by the driving cylinder, the walking beam and the working part of the walking beam to ascend, in an ascending state.

15. The working method of an efficient energy-saving return cylinder of a hydraulic press according to claim 14, wherein in the balancing state, the working method further comprises following steps: filling pressurized oil in an accumulator into a rod chamber of the balancing cylinder, and balancing, using the upward buoyant force of the piston of the balancing cylinder, the weight of the walking beam and the working part of the walking beam.

16. The working method of an efficient energy-saving return cylinder of a hydraulic press according to claim 15, wherein in the descending state, the working method further comprises following steps: filling a rodless chamber of the driving cylinder with pressurized oil, making the pressurized oil in a rod chamber of the driving cylinder return to an oil tank, pressing the pressurized oil in the rod chamber of the balancing cylinder into the accumulator, sucking air into a rodless chamber of the balancing cylinder through a breathing port, thereby making the walking beam and the working part of the walking beam undergo neutral-stroke-rapid-descending.

17. The working method of an efficient energy-saving return cylinder of a hydraulic press according to claim 15, wherein in the ascending state, the working method further comprises following steps: filling the rod chamber of the driving cylinder with the pressurized oil, making oil in the rodless chamber of the driving cylinder flow back to the oil tank, filling by the accumulator the pressurized oil into the rod chamber of the balancing cylinder, and discharging air in the rodless chamber of the balancing cylinder through the breathing port, so that the piston of the balancing cylinder has an upward buoyant force, and the upward buoyant force and the driving force generated by the driving cylinder jointly drive the walking beam and the working part of the walking beam to implement the ascending-returning.

18. The working method of an efficient energy-saving return cylinder of a hydraulic press according to claim 14, wherein in the descending state, the working method further comprises following steps: filling a rodless chamber of the driving cylinder with pressurized oil, making the pressurized oil in a rod chamber of the driving cylinder return to an oil tank, pressing the pressurized oil in the rod chamber of the balancing cylinder into the accumulator, sucking air into a rodless chamber of the balancing cylinder through a breathing port, thereby making the walking beam and the working part of the walking beam undergo neutral-stroke-rapid-descending.

19. The working method of an efficient energy-saving return cylinder of a hydraulic press according to claim 18, wherein in the ascending state, the working method further comprises following steps: filling the rod chamber of the driving cylinder with the pressurized oil, making oil in the rodless chamber of the driving cylinder flow back to the oil tank, filling by the accumulator the pressurized oil into the rod chamber of the balancing cylinder, and discharging air in the rodless chamber of the balancing cylinder through the breathing port, so that the piston of the balancing cylinder has an upward buoyant force, and the upward buoyant force and the driving force generated by the driving cylinder jointly drive the walking beam and the working part of the walking beam to implement the ascending-returning.

20. The working method of an efficient energy-saving return cylinder of a hydraulic press according to claim 14, wherein in the ascending state, the working method further comprises following steps: filling the rod chamber of the driving cylinder with the pressurized oil, making oil in the rodless chamber of the driving cylinder flow back to the oil tank, filling by the accumulator the pressurized oil into the rod chamber of the balancing cylinder, and discharging air in the rodless chamber of the balancing cylinder through the breathing port, so that the piston of the balancing cylinder has an upward buoyant force, and the upward buoyant force and the driving force generated by the driving cylinder jointly drive the walking beam and the working part of the walking beam to implement the ascending-returning.

* * * * *